United States Patent [19]

Rozanski

[11] 4,077,173

[45] * Mar. 7, 1978

[54] SWIMMING POOL CONSTRUCTION

[76] Inventor: Henry A. Rozanski, Box 127, R.D. 2, Elizabethtown, Pa. 17002

[ * ] Notice: The portion of the term of this patent subsequent to Jun. 28, 1991, has been disclaimed.

[21] Appl. No.: 617,173

[22] Filed: Sep. 26, 1975

Related U.S. Application Data

[63] Continuation of Ser. No. 483,720, Jun. 27, 1974, abandoned.

[51] Int. Cl.[2] ..... E02D 27/00; E04B 1/38

[52] U.S. Cl. ..... 52/169.8; 52/146; 52/742; 4/172.21

[58] Field of Search ..... 52/169, 182, 183, 184, 52/742, 704, 707, 297; 182/86, 99; 4/172, 172.19

[56] References Cited

U.S. PATENT DOCUMENTS

| | | | |
|---|---|---|---|
| 1,091,168 | 3/1914 | Sanquist | 52/707 |
| 3,059,243 | 10/1962 | Ross et al. | 52/169 |
| 3,065,820 | 11/1962 | Prizler et al. | 52/704 |
| 3,511,002 | 5/1970 | Fox | 52/169 |
| 3,518,704 | 7/1970 | Shanni | 52/169 |
| 3,810,339 | 5/1974 | Russo | 52/297 |
| 3,820,174 | 6/1974 | Rozanski | 4/172.19 |

FOREIGN PATENT DOCUMENTS

| | | | |
|---|---|---|---|
| 409,349 | 10/1966 | Switzerland | 52/169 |

*Primary Examiner*—Price C. Faw, Jr.
*Assistant Examiner*—Robert C. Farber
*Attorney, Agent, or Firm*—Weiser, Stapler & Spivak

[57] ABSTRACT

A swimming pool construction has an outer shell defined by a plurality of metal sections which are secured to each other and have substantially vertical walls defining the swimming area of the pool. Each metal section includes a coping support extending outwardly of the swimming area in a horizontal direction from the upper end of each vertical wall, and a coping is secured to the coping support about the outer periphery of the swimming area. Transversely spaced sockets for receiving one end of transversely spaced handrails of a swimming pool ladder are secured to the outer end of the coping support prior to the formation of a concrete deck or walk around the outer periphery of the swimming pool. Structural supports are secured to the outer shell of the swimming pool to provide support for the concrete deck or wall. The structural supports extend outwardly of the metal sections of the pool and support horizontally disposed, top angle members which are disposed outwardly of the coping. The coping has a substantially horizontal upper surface which is in horizontal alignment with the top of the top angle members. A concrete form for the deck or walk is defined between the coping, the top of the angle members and the backfill. The upper horizontal surface of the coping and the top of the top angle members form horizontal, spaced guides for deck screeding purposes.

12 Claims, 7 Drawing Figures

SWIMMING POOL CONSTRUCTION

This is a continuation of application Ser. No. 483,720 filed June 27, 1974, now abandoned.

BACKGROUND OF THE INVENTION

1. Field of the Invention

The invention relates to swimming pool constructions, and more specifically, to a structural arrangement for mounting the handrails of a pool ladder, and to a structural support assembly for supporting a concrete deck or walk disposed about the periphery of the pool.

2. Description of the Prior Art

Many swimming pools are constructed with ladders to enable users of the pool to enter the pool, or exit from the pool in an easy manner. These ladders commonly have spaced handrails between which the steps of the ladder are secured. One end of each handrail is normally secured to the inner wall of the swimming pool, and the other end of each handrail is normally mounted within sockets disposed in the concrete deck or walk formed about the outer periphery of the pool. It is common practice to add the ladder to the swimming pool after the concrete deck has been formed. This arrangement requires the accurate positioning of the socket members within the concrete deck, such that they will be in precise alignment for receiving ends of the handrails. This has been a particularly difficult and time consuming operation because of the difficulty of immobilizing the socket members within the concrete while the concrete is setting. Even when the sockets are spaced in precise alignment for receiving the ends of the handrails when the concrete is poured, some misalignment can occur as a result of forces imposed on such sockets during the setting of the concrete deck. If the handrail receiving sockets shift position as a result of the setting of the concrete, they will not be disposed to properly receive the handrails. The misalignment of the sockets results in added costs to remove the sockets from the set concrete to patch the openings from which the sockets were removed, and to reposition the sockets within the concrete in proper position to receive the ends of the handrails.

Prior art pool constructions utilize structural support assemblies for support of concrete decks or walks formed about the outer periphery of a swimming pool. These structural support assemblies partially support the concrete deck but were unable to prevent such deck from cracking as a result of backfill settlement. In forming a concrete deck or walk on the prior art structural support assemblies, it has been common practice to utilize both the backfill and additional forms for confining the concrete during the pouring and setting thereof. The use of separate forms is undesirable because it increases the costs of forming such a concrete deck and the backfill had a tendency to settle, thereby encouraging concrete cracks.

SUMMARY OF THE INVENTION

This invention relates to a unique arrangement for mounting spaced handrails of a ladder utilized in swimming pool construction. Specifically, this invention relates to a unique manner of mounting handrail receiving socket members to receive one end of spaced handrails of a ladder such that the sockets will not become misaligned with handrails during the formation and setting of a concrete deck or walk around the outer periphery of of the swimming pool. The sockets for receiving one end of each handrail are firmly secured to the metal wall sections defining the outer periphery of the swimming pool, and are thereby prevented from shifting as a result of forces imposed thereon during the formation and setting of the concrete deck. In the preferred embodiment of the invention, a pair of sockets are mounted in proper spaced relationship to a separate channel member, and this channel member is firmly secured by bolts, screws, or the like, to a horozontal coping support forming a part of the metal wall sections of the swimming pool. The concrete decks can then be poured about the outer periphery of the pool, and the forces imposed on the handrail receiving sockets will not result in a shifting of said sockets.

This invention also relates to a unique structural support assembly for the concrete deck or walk disposed about the outer periphery of the swimming pool to prevent said concrete deck from cracking as a result of backfill settlement. The structural support assembly of this invention includes a plurality of rods, channels, or the like, disposed outwardly at, and secured to metal wall sections defining the swimming pool area. The structural support assembly carries a top angle member outwardly of the vertical walls defining the swimming pool. The metal sections defining the outer shell of the swimming pool include a coping support extending outwardly at the swimming pool area and a coping is secured about the periphery of the swimming pool to the upper surface of this coping support. The coping has an upper horizontal surface which is in substantially horizontal alignment with the upper margin of the top angle member. The coping, the structural support assembly, the backfill and the top angle member define the form for the concrete deck. The structural support assembly in conjunction with the backfill defines the bottom of this form. The sides of the form are defined by the coping and the top angle member. The upper surface of the coping and the upper margin of the top angle member are guides for screeding the concrete to form a concrete deck which is level with the upper surface of the coping and the top margin of the angle member. In this arrangement, there is no separate form utilized in constructing the concrete deck and all members of the structural support assembly, and the top angle members are retained in position in the completed swimming pool construction. It is noteworthy that the concrete deck is carried entirely by the pool walls and structural support assembly after the concrete has cured, thereby freeing the deck from settlement problems should the backfill settle.

It is therefore an object of the present invention to provide an improved swimming pool construction of the type set forth.

It is another object of the present invention to provide a novel swimming pool construction which includes permanent means to position and secure sockets to receive the ends of swimming pool ladders therein.

It is another object of the present invention to provide a novel swimming pool construction that incorporates a structural steel support to carry a concrete or wooden pool deck.

It is another object of the present invention to provide a novel swimming pool construction which includes means to support a pool deck from the pool wall structural members.

It is another object of the present invention to provide a novel swimming pool construction which incorporates structural steel deck supports and which incorporates self-contained deck forms to permit pouring a concrete deck without the need for additional forms.

It is another object of the present invention to provide a novel swimming pool construction that is rugged in construction, inexpensive in manufacture and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 1:
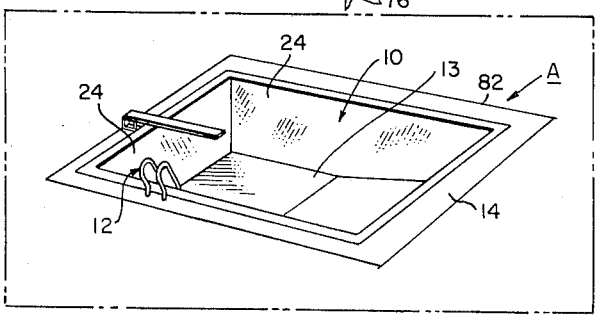
FIG. 1 is an isometric view of a complete swimming pool construction according to the present invention.
Figure 2:
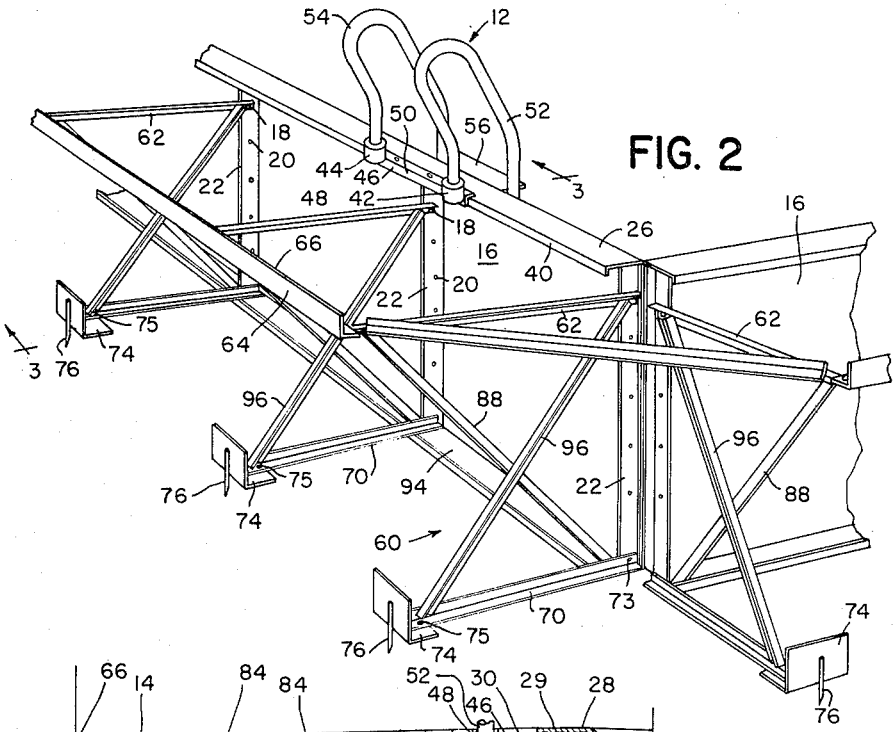
FIG. 2 is an isometric view of a portion of the swimming pool construction shown in FIG. 1, showing the structural framing details.

Referring to FIGS. 1 and 2, a swimming pool construction A includes a swimming pool 10 with a ladder 12 extending into the swimming area 13, and a concrete deck or walk 14 surrounding the outer periphery of the swimming pool. The swimming pool has an outer shell formed by a plurality of wall sections 16. In the preferred embodiment, the sections 16 are made of metal such as steel; however, other materials having sufficient strength for the intended purpose of forming the walls of the swimming pool 10 can be utilized in place of steel. Adjacent metal sections 16 are attached to each other by bolts 18, or other suitable fastening means which extend through aligned openings 20 formed in the outwardly extending side flanges 22. If desired, the metal sections 16 can also be welded together in well-known manner. The inner walls 24 of the metal sections 16 define the swimming pool area 12 of the pool.

Figure 3:
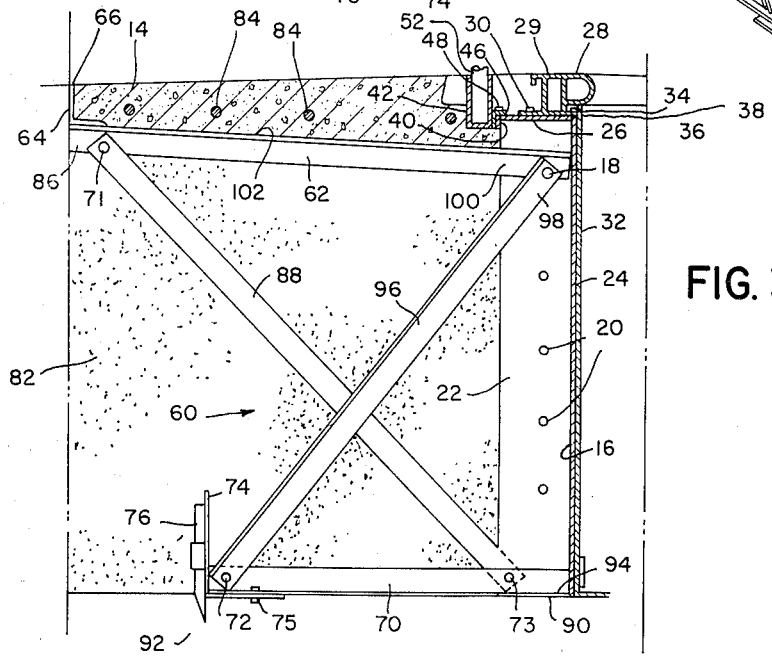
FIG. 3 is a cross sectional view taken along Line 3—3 of FIG. 2, looking in the direction of the arrows and showing the backfill, concrete deck and coping in place.
Figure 6:
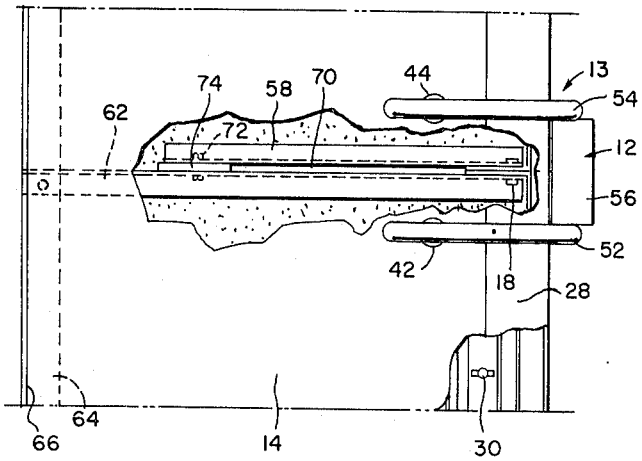
FIG. 6 is a partial top plan view showing the structural arrangement of this invention for mounting a ladder, and partially broken away to expose interior construction details.

Referring to FIGS. 2 and 3, a coping support is defined by a horizontally extending flange 26 which extends outwardly of the swimming area 13 in a horizontal direction from the upper margin of the vertical pool walls 24. These flanges 26 are integrally formed with the vertical walls 24. A coping 28 having an upper surface 29 extends around the upper margin of the swimming pool 10 and is fastened to the horizontally extending flanges 26 by bolts 30, or other suitable fastening. The swimming pool 10 has a plastic liner 32 with a thickened peripheral top edge 34. The thickened peripheral top edge 34 is received within an inwardly directed channel 36 which is formed in the coping 28. The thickened peripheral edge 34 cooperates with an upstanding rib 38 to firmly retain the plastic liner 32 in proper position in accordance with well established pool construction techniques.

The top horizontally extending flange 26 extends outwardly beyond the coping 28 and terminates in a downwardly extending strengthening lip 40 (FIG. 3). A pair of sockets 42, 44 are spaced from each other and are fastened to a socket supporting channel member 46 in permanent manner, such as by welding. The socket supporting channel member 46 is secured to the outer edge of adjacent horizontally extending flanges 26, by bolts 48 or other suitable fastening means. The socket supporting channel member could be secured to a single flange 26 if so desired. The socket supporting channel member 46 has a downwardly extending leg 50 which cooperates with the downwardly extending lip 40 to provide vertical support for said socket supporting channel member 46.

Figure 5:
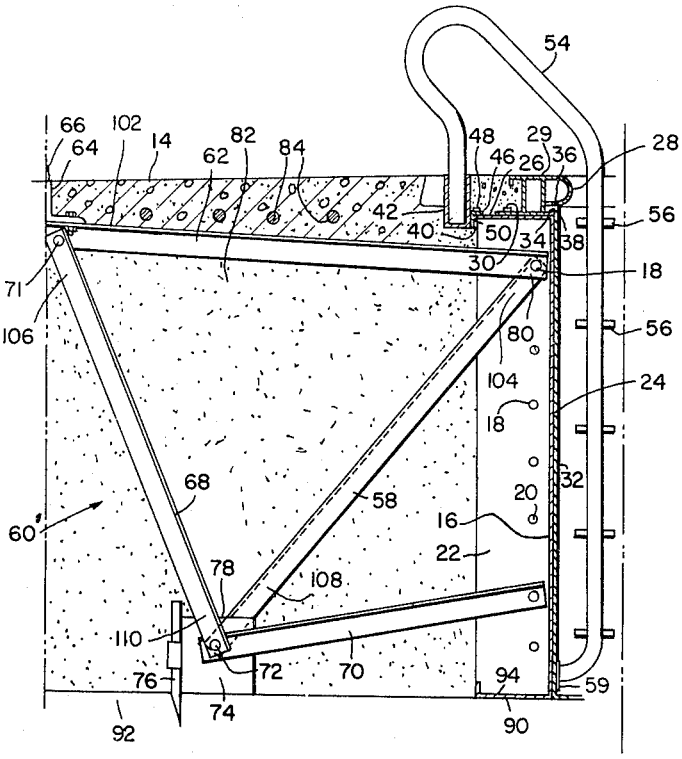
FIG. 5 is a cross section taken along Line 5—5 of FIG. 4, looking in the direction of the arrows and showing the concrete deck, backfill and coping.

The ladder 12 has spaced handrails 52, 54 to which horizontally extending steps 56 are secured. The sockets 42 and 44 are mounted on the socket supporting channel member 46 in precise location for receiving the outer ends of the handrails 52, 54 which are disposed outside of the swimming area 13. The opposite, or inner ends of the handrails have flanges 59 secured thereto (only one of which is shown in FIG. 5), and these flanges are secured to the vertical wall 24 of a metal section 16 in the usual manner. The method of securing the inner ends of the handrails to the vertical wall of a metal section does not form a part of the present invention, and other suitable fastening techniques can be utilized.

The sockets 42 and 44 are firmly secured to the metal sections 16 prior to the pouring of the concrete deck 14. Since the sockets are firmly secured to the metal sections 16, through the channel member 46, they will not become misaligned as a result of forces encountered during the pouring and setting of the concrete deck 14. According to this invention, the precise positioning of handrail receiving socket means 42,44 is accomplished is a simple, reliable and economical manner. Once the concrete deck 14 has set, the outer ends of the handrails can be inserted into the sockets 42,44 and the inner ends of the handrails can be secured to the vertical wall 24 of a metal section 16 to secure the ladder 12 in position.

Referring now to FIGS. 2 and 3, a structural support assembly 60 for the concrete deck or walk 14 is illustrated including a plurality of rearwardly directed generally horizontal, upper bars 62 which are preferably of angle iron constructions. Each upper bar 62 is secured at its forward end to the rearwardly extending side flanges 22 of adjacent metal wall sections 16 by bolts 18. These upper bars 62 outwardly carry the top angle members 64 which may be welded or bolted thereto. Each top angle member 64 has an upper edge 66 which is below horizontal alignment with the upper surface 29 of the coping 28 for deck sloping purposes, as hereinafter more fully described.

Still referring to FIGS. 2 and 3, each upper bar 62 is connected and supported at its remote end 86 by an angularly inclined bracing member 88, which preferably is of angle iron construction. The bracing member 88 connects between the upper support bar 62 at its upper end and the bottom of a side flange 22 to thereby transmit all stresses imposed upon the upper support bar 62 directly upon the wall sections 16. Bolts 71,73 may be employed for bracing member connection purposes or the connections may be otherwise conventionally secured, such as by welding. A stake support block 74 is secured by the bolt 75 to a rearwardly extending lower angle member 70 in substantially horizontal alignment with the bottom surface 90 of the wall section bottom flange 94. It will be appreciated that the pool site must be excavated to a depth equal to the height of the wall sections 16 during pool construction. Accordingly, by positioning the stake support block in alignment with the bottom flange 94 of the wall sections, the support block will then rest upon virgin, unexcavated soil 92. A stake 76 is secured to each stake support block 74 for driving into the virgin soil 92.

A second angularly inclined bracing member 96 crosses the first bracing member 88 to form an X-shaped configuration and has its lower end bolted or otherwise secured to the outboard end of the lower angle member 70, such as by the bolt 72. It is noteworthy that the bracing members 88,96 are not interconnected in any manner and are therefore free to stress entirely independently of each other. The upper end of the bracing member 96 secures to an upright side flange 22 in a bolted or other secure connection. As illustrated, one of the side flange securing bolts 18 can also be employed to secure the upper end 98 of the bracing member 96 and the inward end 100 of the upper bar 62 in a unitary connection. Thus, all forces and stresses imposed upon the stake support block 74 are carried back and are supported by the wall sections 16. Thus, all stresses in the construction which are either upwardly imposed at the pool deck 14 or downwardly imposed at the stake support block 74 are transmitted to the pool wall sections 16 by the bracing members 88,96, the upper bars 62 and the lower angle members 70. After the structural members have been properly positioned and secured as illustrated, the excavated area can be restored with backfill 82 in the usual manner complete from the top of the virgin soil 92 to the top surface 102 of the upper bars 62.

Figure 4:
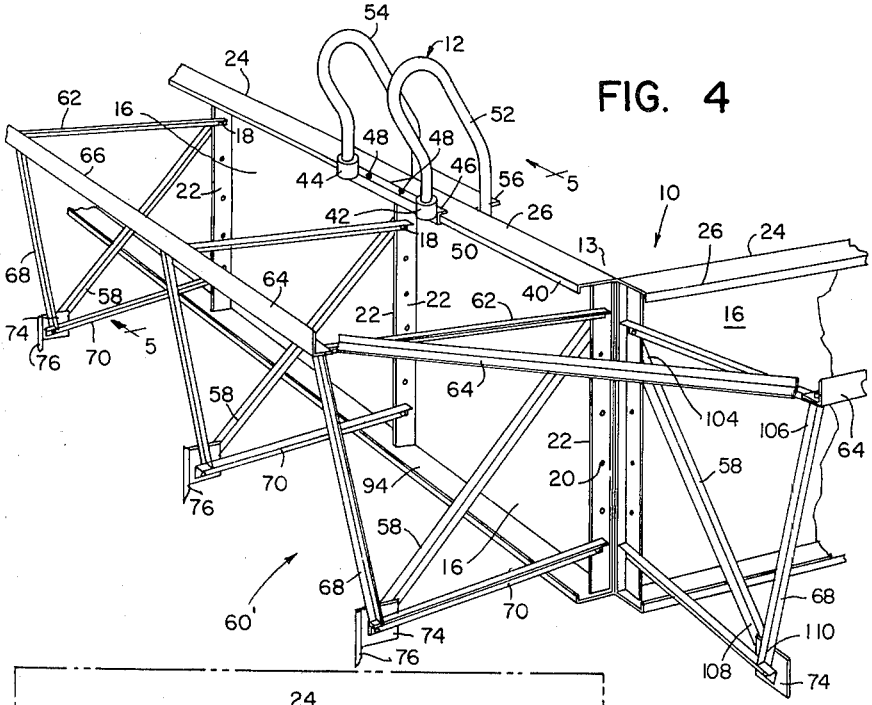
FIG. 4 is an isometric view of a portion of the swimming pool construction shown in FIG. 1 showing details of a modified type of construction.

In the embodiment illustrated in FIGS. 4 and 5, in the structural support assembly 60', each upper bar 62 connects at its respective remote end, to the upper ends 104,106 of the bracing members 58,68 respectively. The respective lower ends 108,110 of bracing members 58,68 which are remote from upper bars 62 are secured to each other and to a rearwardly extending lower angle member 70 by a bolt 72 or other suitable fastening means such as spot welding. A stake support block 74 is secured by the bolt 72 to the bracing members 58,68 and the lower angle member 70. A stake 76 is secured to each stake support block 74 and is driven into virgin soil which is not subject to any appreciable settlement. Backfill 82 is then placed on the virgin soil and is piled substantially to the level of the top of the upper bars 62.

Figure 7:
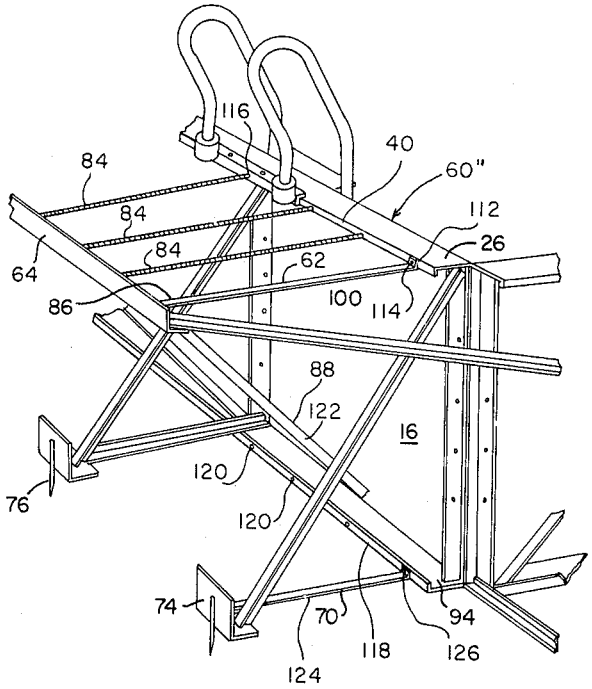
FIG. 7 is an isometric view of a portion of the swimming pool construction shown in FIG. 1, showing details of a second modified type of construction.

In the embodiment illustrated in FIG. 7, in the modified structural assembly 60'', each upper bar 62 connects at its respective remote end 86 to the upper end of the bracing member 88. The inward end 100 of the upper bar 62 terminates inwardly in an unwardly turned flange 112 which is fastened to the strengthening lip 40 of the wall flange 26 in a secure manner such as by a bolt. Preferably the lip 40 is provided with a plurality of longitudinally spaced openings 116 to facilitate attaching the structural assemblies 60'' at any desired location. Similarly, the strengthening lip 118 of the bottom walls section flange 94 is provided with a plurality of longitudinally spaced openings 120 which are vertically aligned below the openings 116. The inward ends 122,124 of the bracing member 88 and the lower angle member 70 are each flanged or otherwise treated to facilitate connection to the lip openings 120 in suitable manner, such as by employing bolts. If desired, reinforcing bars 84 may be positioned into and secured to unused upper lip openings 116 prior to pouring the concrete deck 14.

After the concrete deck 14 has been poured by employing the coping 28, the top angle member 64 and the backfill 82 as a form as hereinbefore set forth, the concrete is allowed to cure a sufficient length of time to develop full strength. At that time, the entire weight of the deck 14 will be carried by the structural support assembly 60,60',60'' and pool wall sections 16 entirely independent of the backfill 82. It is the purpose of this invention to provide a combination wall section 16 and structural support assembly 60,60',60'' of sufficient strength to carry the entire weight of the poured concrete deck 14 and any reinforcing members 84, if used. Thus, should the backfill 82 settle after the pool 10 has been in use for a period of time, there will be no tendency for the deck 14 to crack inasmuch as it is not dependent upon the backfill for support. By providing a swimming pool and deck construction that is entirely self supporting, most of the structural difficulties encountered by prior workers can be overcome.

Although I have described the present invention with reference to the particular embodiments therein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. In a method for forming a concrete deck outwardly of the wall sections of an in-ground swimming pool, said swimming pool having a coping with an upper surface, said coping being supported by the wall sections, the improvement which comprises the steps of:

forming a plurality of structural support assemblies including upper bars and bracing members outwardly of the swimming pool wall sections for aiding in supporting a concrete deck, attaching portions of at least some of the upper bars and bracing members to the wall sections in vertically spaced locations about the periphery of the pool, transmitting stresses imposed upon said structural support assemblies directly upon the wall sections in at least two vertically spaced locations, adjusting the ground level outwardly of the wall sections to form a grade level below said upper bars;

pouring concrete over said structural support assemblies and the grade level to form a peripherally positioned deck; and supporting substantially the entire weight of the deck by the wall sections whereby settlement of the grade level will not affect support of the deck.

2. The method according to claim 1 including the step of angularly positioning at least one of said bracing members relative to a wall section, said one bracing member being positioned to extend from near a bottom edge of a wall section to a portion of the deck that is remotely spaced from the wall section.

3. The method according to claim 1 including the step of angularly intersecting a pair of separate bracing members whereby one of said pair is positioned to extend from near a bottom edge of a wall section to a portion of the deck that is remotely spaced from the wall section and the other one of said pair extends from near a top edge of the wall section.

4. The method according to claim 3 wherein the said pair of bracing members are intersected to form an X-shaped configuration.

5. The method according to claim 3 wherein the said pair of bracing members are intersected without interconnecting.

6. In a method for supporting a swimming pool deck outwardly of the vertical wall sections of an in-ground swimming pool, after excavating the ground to receive the pool, comprising the steps of forming a plurality of structural support assemblies including an upper bar and at least one bracing member for connecting to the wall sections for supporting the deck;

attaching a first portion of the upper bars to the wall sections near the tops thereof about the periphery of the pool and substantially horizontally positioning the upper bars;

attaching a first portion of the bracing members to the wall sections in vertically spaced locations below the upper bars about the periphery of the pool and angularly positioning the bracing members relative to the wall sections;

forming the swimming pool deck above the structural support assemblies and supporting the weight of the deck by the structural support assemblies; and supporting substantially the entire weight of the deck from the wall sections by transmitting the stresses imposed upon said structural support assemblies directly upon the wall sections in at least two vertically spaced locations.

7. The method of claim 6 and the additional step of finishing the inwardly positioned edge of the deck with a coping by positioning the coping in registry over the wall sections.

8. The method of claim 6 and the additional step of angularly intersecting at least some of said bracing members without interconnecting the intersecting members.

9. In a swimming pool construction, the combination of a swimming pool sidewall defining an inner swimming area, said sidewall having a top and a bottom, said sidewall being capable of supporting stresses;

a coping positioned in registry over the sidewall and defining an interior periphery;

a swimming pool deck extending outwardly from the coping to provide a peripheral walkaway;

structural support means disposed outwardly of the sidewall and supporting the deck, said structural support means including means to support the weight of the deck substantially entirely from the sidewall.

10. The swimming pool construction according to claim 9 wherein the means to support comprises at least one pair of angularly inclined bracing members, said bracing members being inclined to form an X-shaped configuration, and one end of each of said pair being connected to the sidewall, one end being connected near the top and the other near the bottom of the sidewall.

11. The swimming pool construction according to claim 10 wherein the angularly inclined bracing members are not interconnected.

12. The swimming pool construction according to claim 10 and means to permit each of said pair of bracing members to stress separately from the other whereby stresses imposed on one bracing member will not be transmitted to the other.

* * * * *